United States Patent [19]

Wallo

[11] 4,352,630

[45] Oct. 5, 1982

[54] HAND FAN ASSEMBLY AND KIT

[75] Inventor: William H. Wallo, Clearwater, Fla.

[73] Assignee: Francis & Lusky Company, Inc., Nashville, Tenn.

[21] Appl. No.: 145,718

[22] Filed: May 1, 1980

[51] Int. Cl.[3] ..... A45B 27/00; B65D 27/00; A63H 9/00

[52] U.S. Cl. ..... 416/70 A; 416/71; 46/115; 46/157; 206/223; 206/579

[58] Field of Search ..... 416/70 A, 71; 46/115, 46/116, 151, 154, 157; 206/575, 577, 579, 223, 216; 229/1.5 C

[56] References Cited

U.S. PATENT DOCUMENTS

| | | | |
|---|---|---|---|
| 1,110,803 | 9/1914 | Lichter | 416/70 A |
| 1,261,482 | 4/1918 | Brewington | 416/71 |
| 2,045,830 | 6/1936 | Brundage | 46/115 |
| 2,122,901 | 7/1938 | Urbanek | 416/70 A |
| 2,281,923 | 5/1942 | Davis | 206/577 Y |
| 2,346,596 | 4/1944 | Martin | 416/71 |
| 2,795,421 | 6/1957 | Toth | 46/157 X |

FOREIGN PATENT DOCUMENTS

| | | | |
|---|---|---|---|
| 551844 | 4/1923 | France | 416/71 |
| 360642 | 7/1938 | Italy | 416/72 |
| 126665 | 11/1949 | Sweden | 46/157 |

*Primary Examiner*—Leonard E. Smith

*Attorney, Agent, or Firm*—Hill, Van Santen, Steadman, Chiara & Simpson

[57] ABSTRACT

A hand fan assembly comprises a fan body having an elongate handle socket extending inwardly from one edge of the body, and an elongate handle having a hand-grip portion and an extension stem projecting from the grip portion and adapted to be retainingly received in the socket. Assembly may be effected by sliding the stem into the socket through an entrance having a threshold to facilitate locating the tip of the stem for insertion into the socket. The stem may be frictionally retained in the socket to maintain the handle in functional assembly with the fan body. The fan body is adapted to be formed by folding panels together along a score line which may have a cut-out to receive the handle stem into the socket. In a kit package the fan body and the handle are enclosed in an envelope with the handle extending across a major dimension of the body.

25 Claims, 9 Drawing Figures

FIG. 1
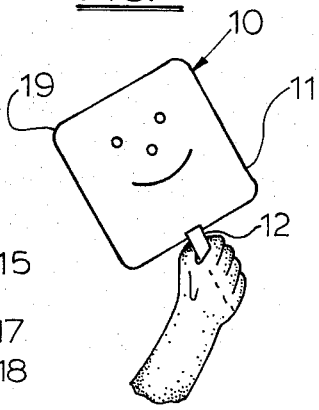
FIG. 2
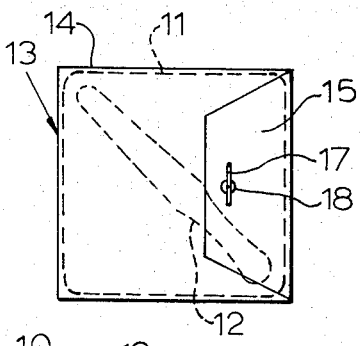
FIG. 5
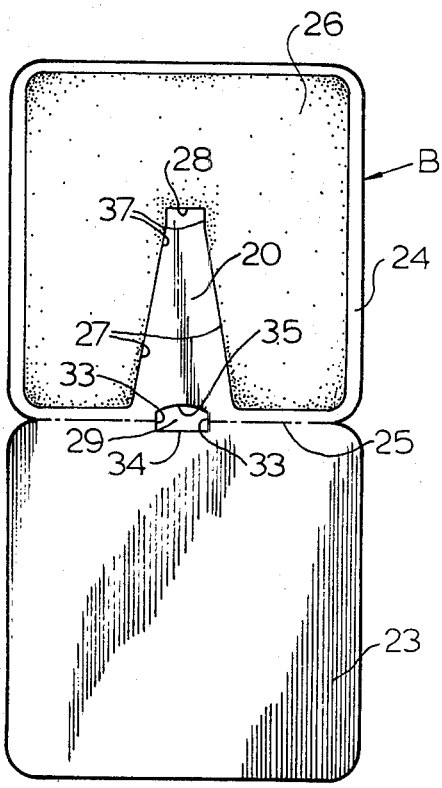
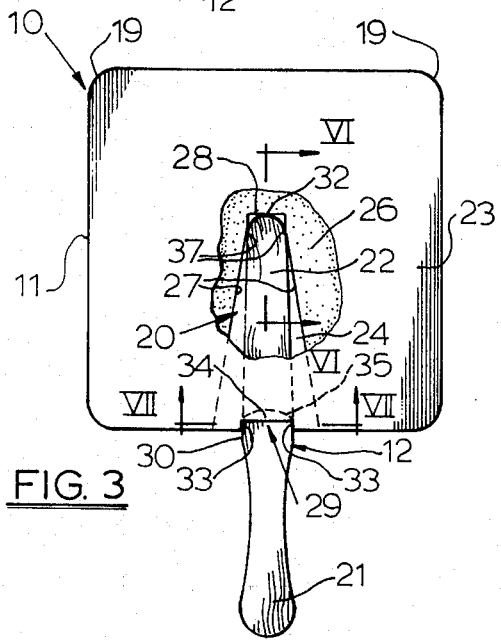
FIG. 3
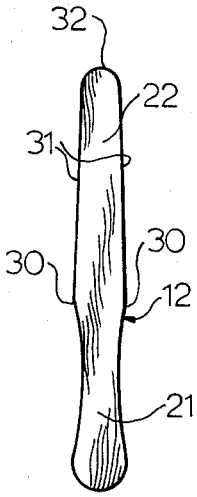
FIG. 4
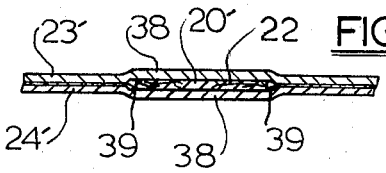
FIG. 9
FIG. 6
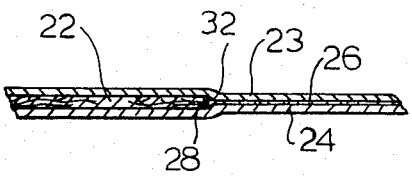
FIG. 7
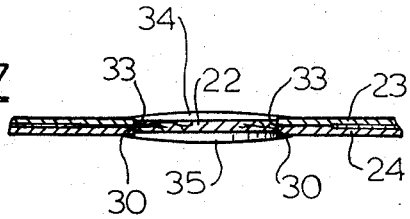
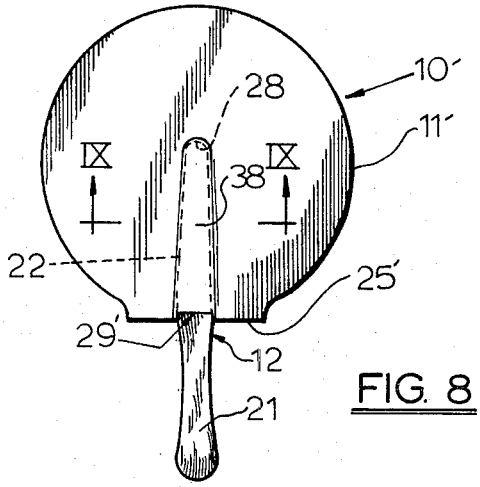
FIG. 8

HAND FAN ASSEMBLY AND KIT

This invention relates to hand fans, and is more particularly concerned with a new and improved hand fan assembly and kit.

Conventional hand fans have a fan body in the form of a panel and a manipulating handle which is generally secured as by means of staples or glue to an outer face of the body panel. Packing of such fans presents a problem due to the handle projecting from one edge of the fan body panel. This requires excessive packing and shipment space. Furthermore, the handle on one outer face obstructs or at least limits the availability of indicia bearing space on that face of the body, thus reducing the promotional indicia value where the fan is to serve as an advertising, program or even listing promotional item, souvenir, and the like, and for which hand fans are commonly supplied.

An important object of the present invention is to provide a new and improved hand fan assembly adapted to be supplied as separate fan body and handle parts arranted to be assembled together by inserting a stem on the handle into a socket provided for the purpose in the fan body.

Another object of this invention is to provide a new and improved hand fan assembly which can be produced at low cost by mass production manufacturing methods and which provides a functionally sturdy and efficient article.

A further object of the invention is to provide a new and improved hand fan assembly kit in which fan body and handle parts are compactly packaged for storage and distribution.

Other objects, features and advantages of the invention will be readily apparent from the following description of certain representative embodiments thereof, taken in conjunction with the accompanying drawing although variations and modifications may be effected without departing from the spirit and scope of the novel concepts embodied in the disclosure and in which:

FIG. 1 is an elevational view of a fan embodying the invention;

FIG. 2 is a plan view of a kit embodying the invention;

FIG. 3 is an enlarged elevational view of the fan of FIG. 1 in part broken away to reveal structural details;

FIG. 4 is an elevational view of the handle of the fan;

FIG. 5 is a plan view of a blank from which the fan body is adapted to be made;

FIG. 6 is an enlarged fragmentary sectional detail view taken substantially along the line VI—VI of FIG. 3;

FIG. 7 is an enlarged fragmentary sectional detail view taken substantially along the line VII—VII of FIG. 3;

FIG. 8 is an elevational view of a modified form of the fan; and

FIG. 9 is an enlarged fragmentary sectional detail view taken substantially along the line IX—IX of FIG. 8.

A hand fan 10 (FIG. 1) embodying the invention comprises a fan body 11 and a handle 12 which is adapted to be grasped for manipulating the fan for its intended purpose. One, and preferably both faces of the body 11 are adapted to be provided with imprinted indicia to suit any particular requirements. Whereas imprinted indicia may be merely ornamental, fans of this type provide advertising devices, means for listing programs at athletic events, conventions, and the like, a means for listing or advertising future event, commercial advertising, souvenir inscription, etc. The fan 10 is especially adapted to be supplied in the form of a kit 13 (FIG. 2) wherein the fan body 11 and the handle 12 are packaged in disassembled form within a packaging envelope 14 of a size to receive the fan body 11 in reasonably close relation with the handle 12 lying across the body 11 whereby the fan assembly is fully contained within the envelope which may have a closure flap 15 adapted to be held in closing relation by means of adhesive or bendable clip means 17 carried by the envelope and extending through an aperture 18. It will be observed that the overall length of the handle 13 is about the same as a major dimension of the body 11 so as to be accommodated readily within the envelope 14, in this instance diagonally between opposite corners of the body 14 where the body is of generally rectangular shape, although desirably provided with four rounded corners 19.

According to the present invention, the fan 10 is constructed and arranged to be readily assembled by the user from a knocked-down condition. For this purpose, the fan body 11 has an elongate handle socket 20 (FIG. 3) extending inwardly from one edge of the body. The handle 12 is of elongate form having a hand grip portion 21 and a stem extension 22 from the grip portion and adapted to be slidably received in the socket 20. Retention of the stem extension within the socket 20 in functional assembly with the body 11 is effected by cooperating friction surfaces on the stem extension and on the body within the socket.

In a best mode construction, the fan body 11 is adapted to be made from a blank B (FIG. 5) of suitable sheet material. Cardboard, self-sustaining plastic sheet, combination plastic and paper or paperboard laminates, and the like may be employed for the purpose. By preference, the blank B comprises a pair of coextensive panels one of which may be identified as a front panel 23 and the other of which may be identified as a back panel 24 connected together along a score line 25 to facilitate bending along the score line and collapsing the panels 23 and 24 into face-to-face coextensive matching laminar engagement. Means for securing the panels 23 and 24 in permanent laminar relation to one another may comprise adhesive 26 which in the course of manufacture may be applied to one of the panels, herein shown as the panel 24, in such a manner as to leave the area for the pocket or socket 20 free at the interfaces of the panels 23 and 24. In a preferred arrangement, the adhesive as applied to the panel 24 outlines the area for the socket 20 along diverging longitudinal lines 27 extending from an inner blind end 28 toward and terminating adjacent to the bend line 25. This leaves the panels 23 and 24 free from one another in a substantial area at each side of an axis intersecting the fold line 25 centrally of its length where a socket entrance cut-out 29 is formed in part in the panel 23 and in part in the panel 24. Upon folding of the panels 23 and 24 together with the adhesive 26 therebetween, the panels are secured into a laminar unitary assembly with each other to form the body 11.

In order to facilitate assembling of the handle 12 with the body 11, the extension stem 22 and the socket 20 and the entrance 29 are cooperatively related in structure. In a preferred form, the handle 12 comprises a flat member made from wood, rigid plastic or the like, having the handle portion 21 shaped for convenient grasping. The handle portion 21 joins the extension stem 22 at lateral shoulders 30 from which sides 31 of the stem 22 converge toward a rounded terminal tip 32. On the body 11, at each side of the entrance cut-out 29, are respective shoulders 33 which face one another in a spaced relation which is just slightly less than the dimension between the widest spread of the handle shoulders 30. On the other hand, the width between the body shoulders 33 is greater than the narrowest dimension between the side edges 31 of the stem 22. Thereby the tip of the stem 22 can be readily received through the entrance 29 into the socket 20. There such reception is facilitated not only by the notch-out at the entrance 29 between the shoulders 33, but also by the socket areas adjacent to the shoulders 33 being free to a substantial width at each side of the entrance 29 so that the portions of the panels 23 and 24 at the entrance 29 can spread apart sufficiently to permit the stem 22 to be slidably inserted into the socket 20. Further to facilitate entry of the tip 32 of the stem 22 into the entrance 29, the notching at the entrance 29 provides at one side of the notch between the shoulders 33 a starter or entrance threshold lip 34, while at the opposite side a clearance recess 35 exposes the threshold lip 34 in the unassembled condition of the parts for ease in locating the lip 34 and thus facilitate entrance of the tip 32 into the socket 20. Through this arrangement, the lip 34 in effect projects outwardly relative to the socket 20. Within the socket the converging sides 27 defined by the adhesive securement 26 serve to guide the tip 32 into centered engagement with the blind and 28 defined by the adhesive securement at the inner end of the socket 20. As the tip 32 bottoms in the blind end 28, confronting shoulders 37 at the inner ends of the sides 27 engage the opposite sides of the tip 32. At the same time, the shoulders 30 at the base of the stem 22 enter into frictional engagement with the shoulders 33. Frictional surface cooperation of the stem 22 and the fan body 11 within socket 20 are provided not only by the stem shoulders 30 and the entrance shoulders 33 (FIG. 7), but also by the stem tip 32 and the shoulders 37 within the socket, and the opposed surfaces of the panels 23 and 24 as held by the securing adhesive 26, as best visualized in FIG. 6. The friction retention of the body 11 and the handle 12 in assembly is ample to maintain the parts functionally against separation in normal usage, but will permit the handle 12 to be withdrawn from the body 11 if desired. Should it be desired to secure the handle 12 permanently in assembly with the body 11, this may be accomplished by placing a dab of adhesive on the stem 22 before inserting the same into the socket 20.

Other shapes than generally rectangular may be provided for the fan body as shown in FIG. 8, where the fan 10' has a body 11' of generally round outline, although the fan body may be provided with any other preferred geometric shape. While in respect to the fan 10, the stem 22 is in effect, forced between and spreads the body panels apart at the entrance 29, the fan body 11' may be provided with a preformed socket 20' in which those portions of the panels 23' and 24' (FIG. 9) defining the socket 20' therebetween may be provided with preformed offsets 38 which are spaced apart slightly less than the thickness of the handle stem 22 and define elongate and converging sides and shoulders 39 which will grip the side edges of the stem 22. Through this arrangement, after the stem 22 has been fully received within the socket 20', the stem will be frictionally engaged throughout substantially its entire length from and including the shoulders 30 in retained relation with the fan body 11'. Similarly as the stem 22 is stopped against over extended insertion into the socket 20 by the shoulder 28 in the fan body 11, a shoulder 28' at the inner end of the socket 20' provides a positive stop against over-insertion of the stem into the body 11'. In other respects, the fan body 11' may be constructed similarly as the fan body 11, the panels 23' and 24' being connected along a score line fold 25', although if preferred the panels of both of fan bodies 11 and 11' may be formed as separate pieces and then assembled together. However, the score folded arrangement is advantageous from a mass production standpoint and lends itself more economically to imprinting the outer faces of the panels in one printing pass through printing apparatus and which apparatus may be part of a continuous production line for making the fan bodies.

It will be understood that variations and modifications may be effected without departing from the spirit and scope of the novel concepts of this invention.

I claim as my invention:

1. A method of making hand fan assembly, comprising:

forming a fan body with an elongate handle socket extending inwardly from one edge of said body;

providing an elongate handle with a hand grip portion and an extension stem projecting from said hand grip portion and adapted to be received in said socket;

providing means for retaining said stem in said socket and thus maintaining said handle in functional assembly with said fan body;

forming said body from a pair of laminar panels;

and preforming matching offsets in said panel defining said socket in the laminar relation of said panels.

2. A method of making a hand fan assembly kit, comprising:

forming a fan body with an elongate handle socket extending inwardly from one edge of said body;

providing an elongate handle with a hand grip portion and an extension stem projecting from said hand grip portion and adapted to be received in said socket;

providing means for retaining said stem in said socket and thus maintaining said handle in functional assembly with said fan body;

forming said body from a single sheet of an area to provide a pair of fan body panels, and folding said panels along a fold bend therebetween into face-to-face alignment with each other;

forming a socket entrance cut-out in said fold bend through which the stem is adapted to be inserted into said socket;

enclosing said fan body in a packaging envelope;

and enclosing said handle in said envelope and extending in crossing relation on said body in a major dimension of said body.

3. A method of making a hand fan assembly, comprising:

forming a fan body with an elongate handle socket extending inwardly from one edge of said body;

providing an elongate handle with a hand grip portion and an extension stem projecting from said hand grip portion and adapted to be received in said socket;

providing means for retaining said stem in said socket and thus maintaining said handle in functional assembly with said fan body;

forming said body from a single sheet of an area to provide a pair of fan body panels, and folding said panels along a fold bend therebetween into face-to-face alignment with each other;

and forming a socket entrance cut-out in said fold bend through which the stem is adapted to be inserted into said socket.

4. A method according to claim 3, comprising applying adhesive to the interfaces of said panels to secure the panels together, and controlling the adhesive to leave the panels free from one another in a substantial area at each side of said entrance cut-out.

5. A hand fan assembly comprising:

a fan body having opposite face panels and an elongate handle socket extending inwardly from one edge of said body between said panels;

an elongate handle having a hand grip portion and an extension stem projecting from said grip portion and adapted to be slidably retainingly received in said socket by endwise insertion through the outer end of said socket;

means for retaining said stem in said socket and thus maintaining said handle in functional assembly with said fan body;

and means at said outer end of said socket for assisting in inserting said stem into said socket;

said guiding means comprising a threshold lip on one of said panels at said outer end of said socket and the opposite panel having a recess aligned with said lip to facilitate placing the tip of said stem on said lip for guiding said tip and thus said stem into said socket.

6. A hand fan assembly kit, comprising:

a fan body having an elongate handle socket extending inwardly from one edge of said body;

an elongate handle having a hand grip portion and an extension stem projecting from said grip portion and adapted to be retainingly received in said socket;

said stem being constructed to be inserted slidably endwise into said socket inwardly from said one edge of said body;

said body having threshold lip guiding means at said outer end of said socket to assist in inserting said stem into said socket;

means for retaining said stem in said socket and thus maintaining said handle in functional assembly with said fan body, including friction surfaces on said body within said socket cooperative with friction surfaces on said stem;

said body having friction shoulders at each side of said lip, and said handle having shoulders engageable with said friction shoulders;

and a packaging envelope, said fan body being received in said envelope, and said handle being of a total length about the same as a major dimension of said body and adapted to be received loosely in crossing relation on said body in said major dimension and enclosed within the envelope with said body, so that by opening the envelope and removing said fan body and said handle from within said envelope, the handle stem portion may be inserted into said socket for functionally completing the hand fan assembly.

7. In a hand fan assembly kit:

a hand fan comprising a pair of panels folded together from a single sheet of material;

means securing confronting faces of said panels in face-to-face relation;

an elongate handle socket extending inwardly between said faces from an entrance opening at one edge of said body;

an elongate handle having a grip portion and a stem portion projecting from the grip portion and adapted to be slidable received through said entrance into assembled relation within said socket;

cooperating friction surfaces on said stem portion and on said panels within said socket for retaining said stem portion in firm assembly within said socket;

friction shoulders at said entrance, and friction shoulder means on said handle engageable with said friction shoulders;

and a kit packaging envelope, said fan body being received in said envelope, and said handle being of a total length about the same as a major dimension of said body and adapted to be received loosely in crossing relation on said body in said major dimension and enclosed within the envelope with said body, so that by opening the envelope and removing said fan body and said handle from within said envelope, the handle stem portion may be inserted into said socket for functionally completing the hand fan assembly.

8. A hand fan assembly comprising:

a fan body having an elongate handle socket extending inwardly from one edge of said body;

an elongate handle having a hand grip portion and an extension stem projecting from said grip portion and adapted to be retainingly received in said socket;

said stem being constructed to be inserted slidably endwise into said socket inwardly from said one edge of said body;

said body having threshold lip guiding means at said outer end of said socket to assist in inserting said stem into said socket;

and means for retaining said stem in said socket and thus maintaining said handle in functional assembly with said fan body, including friction surfaces on said body within said socket cooperative with friction surfaces on said stem, and said body having friction shoulders at each side of said lip, and said handle having shoulders engageable with said friction shoulders.

9. A hand fan assembly according to claim 8, including friction surfaces defining said socket and cooperating with friction surfaces on said stem.

10. A hand fan assembly according to claim 9, including a stop at the inner end of said socket engageable by a tip on said stem for limiting depths of projection of said stem into said socket.

11. A hand fan assembly according to claim 10, wherein said body comprises a pair of panels, and means securing said panels together in face-to-face relation and said panels defining said socket therebetween.

12. A hand fan assembly according to claim 11, wherein said panels are formed from a single sheet and have a fold bend along an edge by which the panels are maintained in face-to-face alignment with each other.

13. A hand fan assembly according to claim 12, wherein said fold bend is along said one edge of said body, and a cut-out in said fold bend provides an entrance into the outer end of said socket.

14. A hand fan assembly according to claim 13, wherein adhesive means secure said panels together, and said panels are free from one another in a substantial area at each side of said entrance.

15. A hand fan assembly according to claim 13, wherein said panels have preformed aligned offset therein defining said socket.

16. A hand fan assembly according to claim 13, wherein said stem is tapered toward its tip to facilitate reception in said socket.

17. A hand fan assembly according to claim 16, wherein said stem is flattened in its major plane, thereby facilitating reception of the stem between said panels in said socket.

18. In a hand fan assembly:

a hand fan comprising a pair of panels folded together from a single sheet of material;

means securing confronting faces of said panels in face-to-face relation;

an elongate handle socket extending inwardly between said faces from an entrance opening at one edge of said body;

an elongate handle having a grip portion and a stem portion projecting from the grip portion and adapted to be slidably received through said entrance into assembled relation within said socket;

cooperating friction surfaces on said stem portion and on said panels within said socket for retaining said stem portion in firm assembly within said socket;

and friction shoulders at said entrance, and friction shoulder means on said handle engageable with said friction shoulders.

19. A hand fan assembly according to claim 18, including outwardly projecting threshold lip means at said entrance to assist in guiding said stem endwise into said socket.

20. A hand fan assembly according to claim 18, wherein said stem is tapered to facilitate guiding the same into said entrance and into position in said socket.

21. A hand fan assembly according to claim 18, wherein said socket includes means for guiding said stem into position within said socket.

22. A hand fan assembly according to claim 18, wherein said socket has a stop at its inner end for opposing the distal end of said stem for limiting projection of said stem into said socket.

23. A hand fan assembly according to claim 18, wherein said panels have preformed offsets aligned with said entrance and with one another and defining said socket.

24. A hand fan assembly according to claim 18, wherein said panels are folded together along a bend line located at said one edge of said body, and a cut-out in said bend provides said entrance.

25. A hand fan assembly according to claim 24, wherein said panels are free from one another in a substantial area at each side of said entrance whereby to facilitate reception of said stem in said socket, and means along said socket for guiding and maintaining the stem in centered relation in the socket in the fully inserted relation of the stem in the socket.

* * * * *